United States Patent [19]

Katsuya et al.

[11] Patent Number: 4,633,805

[45] Date of Patent: Jan. 6, 1987

[54] RELEASE AGENT APPLICATOR FOR COPYING MACHINE

[75] Inventors: Hiroo Katsuya; Chiaki Kato; Yoshiharu Fujii, all of Osaka, Japan

[73] Assignee: Sumitomo Electric Industries, Ltd., Osaka, Japan

[21] Appl. No.: 630,045

[22] Filed: Jul. 12, 1984

[30] Foreign Application Priority Data

Jul. 15, 1983 [JP] Japan ..... 58-129990

[51] Int. Cl.[4] ..... B05C 11/105

[52] U.S. Cl. ..... 118/60; 118/101; 118/260; 432/60

[58] Field of Search ..... 118/101, 60, 260; 432/60; 355/3 FU

[56] References Cited

U.S. PATENT DOCUMENTS 4,375,201 3/1983 Kato ..... 118/101 K

FOREIGN PATENT DOCUMENTS 138670 8/1982 Japan ..... 355/3 FU

*Primary Examiner*—John P. McIntosh

*Attorney, Agent, or Firm*—Sughrue, Mion, Zinn, Macpeak and Seas

[57] ABSTRACT

An improved release agent applicator for use with a copying machine having a fixing device for pressure fusing a toner image to copy paper as the paper is passing between a fixing roll and a pressure roll. The fixing roll has in contact therewith a porous sheet or tube of poly(ethylene tetrafluoride) resin through which the release agent is applied to the fixing roll. The porous sheet or tube is installed on a support in such a manner that part of the sheet or tube projects from an opening of the support. The sheet or tube is provided with a backup which prevents the deformation of the sheet or tube. The backup is provided behind the sheet or tube and extends in the direction of rotation of the fixing roll.

3 Claims, 6 Drawing Figures

RELEASE AGENT APPLICATOR FOR COPYING MACHINE

BACKGROUND OF THE INVENTION

The present invention relates to a device for applying a release agent (for instance, silicone oil) to the fixing roll of a plain paper copying (PPC) machine.

The basic process of fixing in a PPC copying machine consists of pressure fusing a transferred toner image to sheet of paper as it is passed between a heated fixing roll and a resilient pressure roll such as a rubber roll. When the paper with a toner image is passed between the heated fixing roll and the resilient pressure roll, several problems occur, such as the paper sticking to the periphery of the fixing roll so as to prevent complete toner fixing, toner particles coming off the copy paper and being deposited on the fixing roll thereby producing a double image (this phenomenon usually being referred to as "offsetting"), and malfunction of the copying machine. While various methods have been proposed for solving these problems, they all depend on the application of a release agent that provides the fixing roll and elastic roll with good release properties.

However, a great deal of difficulty is involved in applying the release agent to the roll uniformly and in the right amount. If the release agent is applied in excessive amounts, it either stains or discolors the paper, and at the same time, rapid consumption of the release agent requires its frequent refilling. Furthermore, the excess release agent solidifies on the roll surface and may cause unexpected troubles. If the amount of application of the release agent is insufficient, offsetting or deteriorated release properties of the roll surface will occur that induces the sticking of the paper to the periphery of the roll. Typical release agents are heat-resistant oils such as silicone oil.

Various types of release agent applicators have so far been proposed, but none of them are completely satisfactory. The applicant previously developed a release agent applicator that permits uniform application of the release agent, consumes a minimum amount of the agent, requires a very small installation area, and which is simple in shape and can be manufactured at a very low cost.

As shown in FIGS. 1A, 1B and 2, this applicator is used with a fixing device composed of a fixing roll 14 and a pressure roll 15 between which copy paper 16 having a toner image 19 is passed so as to pressure fuse the image to the paper. The applicator consists of a porous receptacle in the form of a porous tube 7 of poly(ethylene tetrafluoride) resin which is heat sealed or stoppered at both ends and placed in contact with the fixing roll 14 in its axial direction so as to enable the application of the release agent 6 from the porous tube of poly(ethylene tetrafluoride) resin.

Being soft, the porous tube 7 is carried on a support 1 (FIGS. 1A and 1B) or 4 (FIG. 2) in such a manner that part of the tube projects from the opening of the support. The pores in the area of the porous tube other than the outlet for the release agent are closed with fluorine rubber or any other suitable by, for example, coating or covering techniques, so as to produce a pore closed area. This is done in order to discharge the release agent in a metered and uniform amount.

In FIGS. 1A and 1B, reference numeral 2 indicates the closed-pore area of the porous tube of poly(ethylene tetrafluoride) resin, 3 refers to the pore open area of that tube, and 5 denotes an inlet for the release agent.

The formation of the closed-pore area in the tube may be realized by contact with the support as shown in FIG. 3. The inventors also developed an applicator replacing the porous tube of poly(ethylene tetrafluoride) resin with a porous receptacle in the form of a sheet of the same material as shown in FIG. 4. However, even these prior art applicators are not completely defect free. During the copying operation, the projecting part of the porous sheet or tube is dragged by the rotating fixing roll, deforming to such an extent that complete application of the release agent is prevented.

SUMMARY OF THE INVENTION

The present invention has been accomplished to solve this problem and prevent the deformation of the projecting porous sheet or tube with the aid of backup means.

The release agent applicator of the present invention for use with a copying machine has a fixing device for pressure fusing a toner image to copy paper as the latter is being passed between a fixing roll and a pressure roll, the fixing roll having in contact therewith a porous sheet or tube of poly(ethylene tetrafluoride) resin that is designed to permit application of a release agent. The applicator is characterized in that the porous sheet or tube of poly(ethylene tetrafluoride) resin is installed on a tank or support (collectively referred to hereinafter as a support) in such a manner that part of the sheet or tube projects from the opening of the support. The sheet or tube is provided with a backup means for preventing the deformation of the sheet or tube. The backup means is provided behind the sheet or tube, extending in the direction of rotation of the fixing roll and having a height A which is more than half of the projection height B of the sheet or tube so as to satisfy the relation $A > \frac{1}{2}B$, where the reference level for each height is the base of the opening.

DESCRIPTION OF THE PREFERRED EMBODIMENTS

The present invention is hereunder described in detail with reference to the accompanying drawings.

Figure 1A:
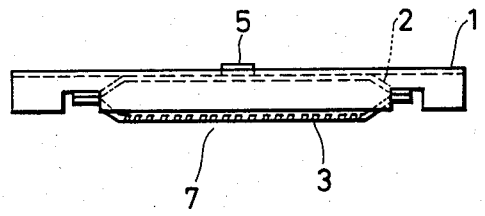
FIG. 1A is a front view and FIG. 1B a cross section of a release agent applicator previously developed by the present applicant.
Figure 1B:
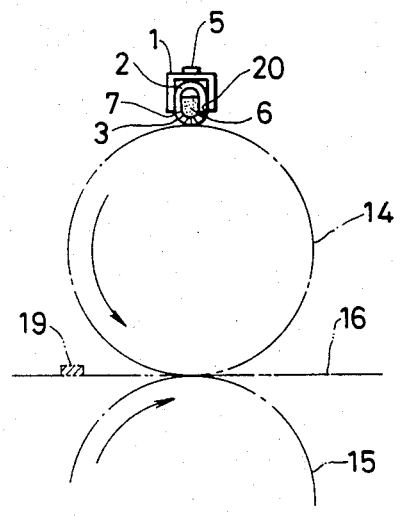
Figure 2:
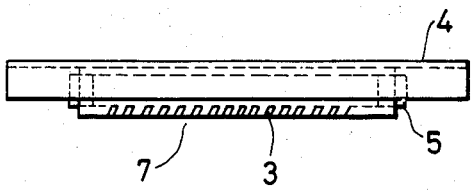
FIG. 2 is a front view and FIGS. 3 and 4 are cross sections of the applicator of FIGS. 1A and 1B.
Figure 3:
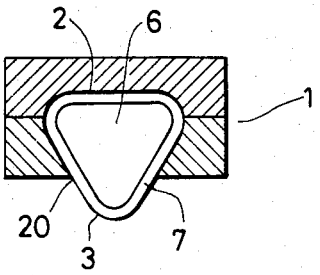
Figure 4:
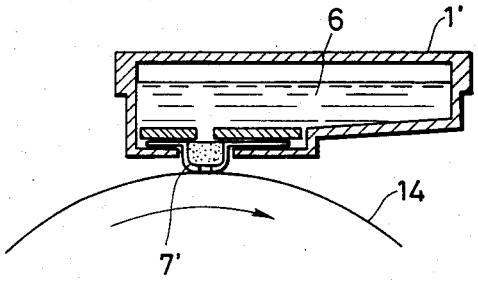
Figure 5:
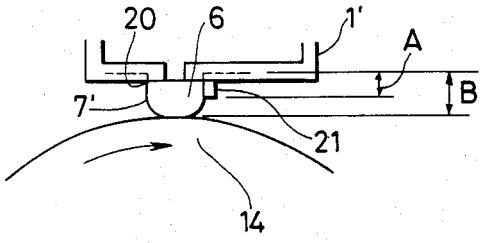
FIG. 5 is a side view illustrating a release agent applicator of the present invention.

FIG. 5 illustrates a release agent applicator of the present invention that corresponds to the embodiment shown in FIG. 4. (The present invention is also applicable to the embodiments shown in FIGS. 1, 2 and 3.) In FIG. 5, reference numeral 7' indicates a porous sheet of poly(ethylene tetrafluoride) resin having fine pores with a uniformly controlled pore size, preferably in the range of 0.1 to 10 microns, and a porosity of 50 to 85%. Examples of such a sheet are described in Japanese Patent Publication No. 13560/1967 and Japanese Published Patent Application No. 155226/1975. It is manufactured by preparing a poly(ethylene tetrafluoride) resin mix containing a liquid lubricant, calendering the mix to sheet form, drawing the sheet and sintering the drawn sheet. A commercial product of this porous sheet of poly(ethylene tetrafluoride) resin is Poreflon (trademark) available from Sumitomo Electric Industries, Ltd., of Japan.

Usually, the pores in the area of the sheet other than that which has open pores necessary for permitting the oozing of the release agent 6 are closed with FEP or other material, and the sheet is installed on a support 1' in such a manner that the open-pore area of the sheet contacts the fixing roll 14 and part of the sheet projects from the opening 20 of the support (also see FIG. 4).

According to the present invention, the porous sheet 7' is provided with a backup 21 (shown as a projecting wall in FIG. 5) whose height A is more than half of the height B of the projection of the sheet as calculated from the support opening 20, that is $A > \frac{1}{2}B$. The backup 21 backs up the projection of the sheet 7' and prevents its deformation.

For a better understanding of this feature of the present invention, experimental results are shown below by reference to FIG. 5. In the experiment, the projecting height B of the porous sheet was 6 mm, and the height A of the backup was 3.5 mm. Poreflon (trademark) mentioned above was used as the porous sheet 7'. In the experiment, the backup proved to be sufficiently effective in preventing the deformation of the sheet due to the rotation of the fixing roll.

As described above, the applicator of the present invention is equipped with a backup that effectively prevents the deformation of the porous sheet or tube projecting from the opening of the support, even if the projection is dragged by the rotating fixing roll during the application of the release agent. Therefore, the device of the present invention ensures application of the correct amount of the release agent, and hence causes none of the problems described above related to excessive or insufficient application of release agent.

What is claimed is:

1. In a release agent applicator for use with a copying machine having a fixing device for pressure fusing a toner image to copy paper as said paper is being passed between a fixing roll and a pressure roll, said fixing roll having in contact therewith a porous receptacle of poly(ethylene tetrafluoride) resin for applying a release agent to said fixing roll, the improvement wherein said porous receptacle of poly(ethylene tetrafluoride) resin is installed on a support in such a manner that part of said receptacle projects from an opening of the support, said receptacle being provided with a backup means for preventing deformation of said receptacle, said backup means being provided behind said receptacle in the direction of rotation of said fixing roll and along substantially the entire length of said receptacle, and having a height A which is more than half of a projection height B of said receptacle so as to satisfy the relation $A > \frac{1}{2}B$, wherein a reference level for each height is a base of said opening.

2. The release agent applicator for use with a copying machine according to claim 1, wherein said porous receptacle of poly(ethylene tetrafluoride) resin has a pore size in the range of 0.1 to 10 microns and a porosity in a range of 50 to 85%.

3. The release agent applicator for use with a copying machine according to claim 1, wherein said porous receptacle of poly(ethylene tetrafluoride) resin has a closed pore area.

* * * * *